US006417151B1

(12) United States Patent
Grothus et al.

(10) Patent No.: US 6,417,151 B1
(45) Date of Patent: Jul. 9, 2002

(54) ACTIVATORS FOR PEROXIDE COMPOUNDS IN DETERGENTS AND CLEANING AGENTS

(75) Inventors: Marita Grothus, Friedberg; Albrecht Weiss, Langenfeld; Beatrix Kottwitz; Ulrich Pegelow, both of Duesseldorf; Guenter Uphues, Monheim; Inken Prueser, Duesseldorf, all of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/402,404

(22) PCT Filed: Mar. 26, 1998

(86) PCT No.: PCT/EP98/01804

§ 371 (c)(1),
(2), (4) Date: Oct. 4, 1999

(87) PCT Pub. No.: WO98/45398

PCT Pub. Date: Oct. 15, 1998

(30) Foreign Application Priority Data

Apr. 4, 1997 (DE) ..... 197 13 852

(51) Int. Cl.[7] ..... C11D 3/00; C11D 7/18; C11D 7/54

(52) U.S. Cl. ..... 510/312; 510/309

(58) Field of Search ..... 510/309, 312

(56) References Cited

U.S. PATENT DOCUMENTS

| | | | | |
|---|---|---|---|---|
| 3,635,828 A | | 1/1972 | Benjamin et al. | 252/99 |
| 4,539,130 A | * | 9/1985 | Thompson et al. | 252/94 |
| 4,585,642 A | | 4/1986 | Rieck | 423/333 |
| 4,664,839 A | | 5/1987 | Rieck | 252/175 |
| 4,820,439 A | | 4/1989 | Rieck | 252/135 |
| 4,966,996 A | | 10/1990 | Schaeffer | 562/598 |
| 5,183,651 A | | 2/1993 | Schimmel et al. | 423/334 |
| 5,229,095 A | | 7/1993 | Schimmel et al. | 423/334 |
| 5,268,156 A | | 12/1993 | Schimmel et al. | 423/334 |
| 5,308,596 A | | 5/1994 | Kotzian et al. | 423/333 |
| 5,318,733 A | | 6/1994 | Carduck et al. | 264/15 |
| 5,356,607 A | | 10/1994 | Just | 423/334 |
| 5,358,655 A | | 10/1994 | Kruse et al. | 252/95 |
| 5,382,377 A | | 1/1995 | Raehse et al. | 252/174 |
| 5,417,951 A | | 5/1995 | Just | 423/334 |
| 5,534,180 A | * | 7/1996 | Miracle et al. | 510/220 |
| 5,541,316 A | | 7/1996 | Engelskirchen et al. | 510/471 |
| 5,580,941 A | | 12/1996 | Krause et al. | 527/300 |
| 5,616,550 A | | 4/1997 | Kruse et al. | 510/444 |
| 5,783,616 A | | 7/1998 | Krause et al. | 524/58 |
| 5,830,956 A | | 11/1998 | Stockhausen et al. | 526/318.2 |
| 5,847,065 A | | 12/1998 | Kause et al. | 527/300 |
| 5,854,191 A | | 12/1998 | Krause et al. | 510/276 |
| 5,854,321 A | | 12/1998 | Krause et al. | 524/58 |

FOREIGN PATENT DOCUMENTS

| | | |
|---|---|---|
| CA | 1 036 455 | 8/1977 |
| DE | 18 18 729 | 11/1969 |
| DE | 20 64 146 | 7/1971 |
| DE | 24 12 837 | 10/1974 |
| DE | 25 57 623 | 6/1977 |
| DE | 42 21 381 | 2/1994 |
| DE | 43 00 772 | 7/1994 |
| DE | 43 03 320 | 8/1994 |
| DE | 44 17 734 | 11/1995 |
| DE | 195 45 729 | 6/1997 |
| EP | 0 072 098 | 2/1983 |
| EP | 0 164 514 | 12/1985 |
| EP | 0 164 552 | 12/1985 |
| EP | 0 293 753 | 12/1988 |
| EP | 0 452 428 | 3/1991 |
| EP | 0 425 427 | 5/1991 |
| EP | 0 436 835 | 7/1991 |
| EP | 0 486 592 | 5/1992 |
| EP | 0 502 325 | 9/1992 |
| EP | 0 530 949 | 3/1993 |
| EP | 0 548 599 | 6/1993 |
| EP | 0 579 659 | 1/1994 |
| EP | 0 591 282 | 4/1994 |
| EP | 0 603 931 | 6/1994 |
| EP | 0 642 576 | 3/1995 |
| EP | 0 684 304 | 11/1995 |
| EP | 0 699 745 | 3/1996 |
| JP | 1 198700 | 10/1989 |
| JP | 4 238809 | 8/1992 |
| JP | 4 260610 | 8/1992 |
| WO | WO91/01295 | 2/1991 |
| WO | WO91/02781 | 3/1991 |
| WO | WO91/08171 | 6/1991 |
| WO | WO92/06154 | 4/1992 |
| WO | WO92/11347 | 7/1992 |
| WO | WO93/16110 | 8/1993 |
| WO | WO94/12619 | 6/1994 |
| WO | WO94/12620 | 6/1994 |
| WO | WO94/12621 | 6/1994 |
| WO | WO94/23005 | 10/1994 |
| WO | WO94/25574 | 11/1994 |
| WO | WO95/07972 | 3/1995 |

OTHER PUBLICATIONS

Database WPI, Class A97, AN–89–274106, XP002077070.
Tensioactivos Cationicos Basados EN Esteres De Trietanolamina, pp. 167–179 (1992).
A New Generation of Softner Raw Materials, pp. 59–68 (1993).

* cited by examiner

*Primary Examiner*—Yogendra N. Gupta
*Assistant Examiner*—John M Petruncio
(74) *Attorney, Agent, or Firm*—Wayne C. Jaeschke; Glenn E.J. Murphy

(57) ABSTRACT

A detergent or disinfectant composition comprising is presented having 0.5 to 10 percent by weight of an activator compound which under perhydrolysis conditions forms a percarboxylic acid, and releases a leaving group capable of being used as a substrate for enzymes, and up to 50 percent by weight of a peroxygen compound. The composition increases the oxidation of peroxide compounds in oxidation, bleaching, detergent, cleaning and disinfecting solutions, especially at low temperatures.

25 Claims, No Drawings

ACTIVATORS FOR PEROXIDE COMPOUNDS IN DETERGENTS AND CLEANING AGENTS

This application is filed under 35 U.S.C. 371 and based on PCT/EP98/01804, filed Mar. 26, 1998.

BACKGROUND OF THE INVENTION

1. Field of the Invention

This invention relates to use of activators which, when subjected to perhydrolysis, release a carboxylic acid with elimination of a leaving group suitable as a substrate for enzymes, more particularly redox-active enzymes, for boosting the bleaching effect of peroxygen compounds, more particularly inorganic peroxygen compounds, and to laundry detergents, cleaners and disinfectants which contain such activators and a peroxygen compound.

2. Discussion of Related Art

Inorganic peroxygen compounds, more particularly hydrogen peroxide, and solid peroxygen compounds which dissolve in water and release hydrogen peroxide in the process, such as sodium perborate and sodium carbonate perhydrate, having long been used as oxidizing agents for disinfecting and bleaching purposes. In dilute solutions, the oxidizing effect of these substances depends to a large extent on the temperature. For example, with $H_2O_2$ or perborate in alkaline bleaching liquors, sufficiently rapid bleaching of soiled textiles is only achieved at temperatures above about 80° C. At lower temperatures, the oxidizing effect of the inorganic peroxygen compounds can be improved by addition of so-called activators for which there have been numerous proposals in the literature, above all from the classes of N- or O-acyl compounds, for example polyacylated alkylenediamines, more especially tetraacetyl ethylenediamine, acylated glycolurils, more especially tetraacetyl glycoluril, N-acylated hydantoins, hydrazides, triazoles, hydrotriazines, urazoles, diketopiperazines, sulfuryl amides and cyanurates, also carboxylic anhydrides, more especially phthalic anhydride, carboxylic acid esters, more especially sodium nonanoyloxybenzenesulfonate, sodium isononanoyloxybenzenesulfonate, and acylated sugar derivatives, such as pentaacetyl glucose. By adding these substances, the bleaching effect of aqueous peroxide liquors can be increased to such an extent that the same effects are obtained at temperatures as low as 60° C. as are obtained with the peroxide liquor alone at 95° C. The bleach-boosting effect of such substances is essentially attributable to the fact that, in the presence of peroxygen compounds, i.e. under perhydrolysis conditions, percarboxylic acids which generally have a greater oxidizing or bleaching effect than the peroxygen compound used are formed from the substances with elimination of the rest of the molecule, the so-called leaving group.

In the search to find energy-saving washing and bleaching processes, application temperatures well below 60° C. and, more particularly, below 45° C. down to the temperature of cold water have acquired increasing significance in recent years.

At temperatures as low as these, the effect of hitherto known activator compounds generally undergoes a distinct deterioration. Accordingly, there has been no shortage of attempts to develop more effective activators for this temperature range although, hitherto, they have failed to produce any convincing results. The problem addressed by the present invention also was to improve the oxidizing and bleaching effect of inorganic peroxygen compounds at low temperatures below 80° C. and, more particularly, in the temperature range from about 15° C. to 45° C.

DESCRIPTION OF THE INVENTION

It has now been found that, where compounds of the above-mentioned type which releases percarboxylic acids under perhydrolysis conditions are used as activators, more particularly in this temperature range, a substantial increase in the oxidizing and bleaching effect of peroxygen compounds, more especially inorganic peroxygen compounds, in oxidizing, bleaching, washing, cleaning or disinfecting solutions is achieved when, on perhydrolysis, these compounds release a leaving group which may be used as a substrate for enzymes, more particularly redox-active enzymes.

Preferred bleach activators which release an enzyme substrate leaving group of the type in question under perhydrolysis conditions include quaternized carboxylic acid alkanolamine esters, so-called esterquats. Esterquats are known group of cationic surfactants which are normally obtained by esterification of alkanolamines, such as triethanolamine, or triethanolamine polyglycol ethers with carboxylic acids and subsequent quaternization in organic solvents. By virtue of their fabric-softening effect, they have hitherto largely been used in detergents and, more particularly, laundry aftertreatment compositions. The production and properties of esterquats are described, for example, in International patent application WO 91/01295 and in the synoptic articles by O. Ponsati in C.R. CED Congress, Barcelona, 167 (1992) and R. Puchta in C.R. CED Congress, Sitges, 59 (1993).

In the context of the invention, esterquats are understood to be quaternized carboxylic acid monoesters, diesters or triesters corresponding to general formula (I):

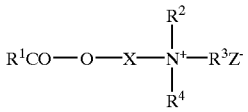

(I)

in which $R^1CO$— is a saturated and/or unsaturated acyl group containing 2 to 22 carbon atoms, more especially 2 to 12 carbon atoms and preferably 8 to 10 carbon atoms, $R^2$ is an optionally substituted, linear or branched alkyl, alkenyl or aryl group containing 1 to 22 carbon atoms, more particularly 1 to 3 carbon atoms, or the group —X—OH, $R^3$ and $R^4$ independently of one another have the same meaning as $R^2$ or stand for $R^1CO$—O—X—, X is a linear or branched alkylene group containing 2 to 22 carbon atoms optionally interrupted by 1 to 10 oxygen atoms and $Z^-$ is a charge-equalizing anion, more especially halide, methosulfate or ethosulfate.

Preferred compounds of formula (I) are those in which at least one of the substituents of the quaternized nitrogen atom contains an alkylene group interrupted by oxygen atoms (X in formula I). The group O—X is preferably an optionally oligomeric ethyleneoxy and/or propyleneoxy group, the degrees of oligomerization in these groups preferably being from 2 to 5. The number of groups $R^1CO$ in the compounds corresponding to formula (I) is 1 to 3. Quaternization products of technical mono-/di-/triester mixtures, in which the degree of esterification, i.e. the average number of groups $R^1CO$ per molecule, is between 1.2 and 2.2 and preferably between 1.5 and 1.9, are preferably used. Derivatives of esters which are derived from technical $C_{12/18}$ or $C_{16/18}$ fatty acids, for example palm oil fatty acid, cocofatty acid or tallow fatty acid, and which may have an iodine value of 0 to 40 may also be used. Esterquats such as these are perhydrolyzed in the presence of hydrogen peroxide with cleavage of the ester bonds and release of the percarboxylic acid $R^1COOH$. A compound corresponding to general formula II:

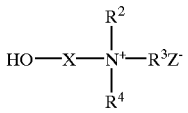

(II)

in which X, $R^2$, $R^3$, $R^4$ and Z have the same meaning as in formula (I), is formed from the leaving group.

The above-mentioned substituents in $R^2$ may be, for example, halogens, such as chlorine, fluorine or iodine, an also ionic groups, such as sulfate, sulfonate, carboxylate, phosphate or phosphonate, or the acid groups on which they are based. In the last-mentioned cases, the anion ($Z^-$ in formula I) may even be absent.

The bleach activator containing an enzyme substrate leaving group, preferably an esterquat corresponding to formula (I), is preferably used for bleaching colored soils in the washing of textiles, more especially in an aqueous surfactant-containing liquor. The expression "bleaching of colored soils" is meant to be interpreted as its broadest sense and encompasses both the bleaching of soil present on the textile, the bleaching of soil detached from the textile and present in the wash liquid and the inhibition of dye transfer, i.e. the oxidative destruction of textile dyes present in the wash liquor, having been detached from the textiles under the washing conditions, before they can be absorbed by textiles of a different color. Where esterquats are used as the bleach activator in this preferred application, their fabric-softening properties can be instrumental as another advantage of the invention unless of course the esterquat is completely destroyed by perhydrolysis.

Another, less preferred form of application according to the invention is the use of the bleach activator containing the enzyme substrate leaving group, more particularly an esterquat corresponding to formula (I), in cleaning solutions for hard surfaces, more particularly for crockery, for bleaching colored soils. In this case, too, the expression "bleaching" encompasses both the bleaching of soil present on the hard surface, more especially tea, and the bleaching of soil detached from the hard surface and present in the dishwashing liquor.

The present invention also relates to a process for activating peroxygen compounds using bleach activators containing an enzyme substrate leaving group, more especially esterquats corresponding to formula (I), and to laundry detergents, dishwashing detergents and disinfectants containing peroxygen-based bleaching agents and—to boost the bleach effect—a bleach activator containing an enzyme substrate leaving group, more especially an esterquat corresponding to formula (I).

Suitable peroxygen compounds are, in particular, organic peracids which do not correspond to the above formula $R^1COOH$ and peracidic salts of organic acids, such as phthalimidopercaproic acid, perbenzoic acid or salts of diperoxydodecanedioic acid, hydrogen peroxide and inorganic salts which release hydrogen peroxide under the washing or dishwashing conditions, such as perborate, percarbonate, perphosphate and/or persilicate, either individually or in the form of mixtures. If solid peroxygen compounds are to be used, they may be used in the form of powders or granules which may even be coated in known manner. The peroxygen compounds may be added to the washing or dishwashing liquor either as such or in the form of preparations containing them which, in principle, may contain any typical ingredients of laundry detergents, dishwashing detergents or disinfectants. It is particularly preferred to use alkali metal percarbonate, alkali metal perborate monohydrate, alkali metal perborate tetrahydrate or hydrogen peroxide in the form of aqueous solution containing 3% by weight of to 10% by weight of hydrogen peroxide. Peroxygen compounds are present in the laundry or dishwashing detergents according to the invention in quantities of preferably up to 50% by weight and more particularly from 5% by weight to 30% by weight whereas disinfectants according to the invention contain peroxygen compounds in quantities of preferably 0.5% by weight to 40% by weight and, more preferably, 5% by weight to 20% by weight.

In the process according to the invention and in a use according to the invention, the compound containing an enzyme substrate leaving group, more particularly the esterquat corresponding to formula (I), may be used as an activator for any application requiring a particular increase in the oxidizing effect of the peroxygen compounds at low temperatures, for example in the bleaching of textiles or hair, in the oxidation of organic or inorganic intermediate products and in disinfection. The bleach-boosting compounds containing an enzyme substrate leaving group are present in compositions according to the invention in quantities of preferably 0.5% by weight to 10% by weight and, more preferably, 1% by weight to 8% by weight.

The above-mentioned perhydrolytic release of the percarboxylic acid, for example the cleavage of the ester function is the esterquat, can be further enhanced by the catalysis of a hydrolase enzyme. The fact that such enzymes are capable of this had in no way been expected because they are not normally capable of binding charged fatty acid derivatives. Hydrolases are understood to be enzymes which are capable of cleaving the corresponding bond relatively quickly to form the period. The activity of enzymes is normally expressed in U/g, the unit 1 U corresponding to the activity of that quantity of enzyme which reacts 1 $\mu$mole of its substrate in 1 minute at an optimum pH value and at a temperature of 25° C. 1 U thus corresponds to 1/60 $\mu$catal. Hydrolases particularly suitable for the purposes of the present invention preferably have high perhydrolysis activities. Not only (by definition) ester-cleaving esterases, but also certain representatives of the proteases are capable of perhydrolytic cleavage of the ester bond in the esterquat. Enzymes from the group of lipases or cutinases, which may be regarded as subgroups of the esterases, may also be used for the purposes of the invention.

In this activating system of hydrolase and activator containing an enzyme substrate leaving group, more especially an esterquat, the ratio by weight of activator to hydrolase enzyme is preferably in the range from 1,000,000:1 to 50:1 and more preferably in the range from 1,000:1 to 100:1.

The use according to the invention essentially consists in creating conditions under which the peroxygen compound and the activating compound containing an enzyme substrate leaving group according to the invention are able to react with one another with the object of obtaining products with a stronger oxidizing effect. Conditions such as these prevail in particular when the reactants encounter one another in aqueous solution. This can be achieved by separately adding the peroxygen compound and the activating compound containing an enzyme substrate leaving group, for example the esterquat, to a solution optionally containing a laundry detergent or dishwashing detergent. In a particularly advantageous embodiment, however, the process according to the invention is carried out using a laundry detergent, dishwashing detergent or disinfectant according to the invention containing a peroxidic oxidizing agent. The peroxygen compound may also be separately added as such or as a preferably aqueous solution or suspension to the washing, dishwashing or disinfecting solution where a peroxygen-free composition is used.

The conditions may be varied within wide limits according to the application envisaged. Thus, besides purely aqueous solutions, mixtures of water and suitable organic solvents may be used as the reaction media. The quantities of peroxygen compound used are generally selected so that the solutions contain between 10 ppm and 10% of active oxygen and preferably between 50 and 5,000 ppm of active oxygen. The quantity of esterquat used also depends on the application envisaged. It is preferably used in such quantities that a concentration of 25 ppm to 1% by weight is present in the aqueous liquor, although these limits may even be exceeded in special cases.

In one particular embodiment of the invention, the peroxygen compound to be activated in hydrogen peroxide and is provided by an enzymatic system which is capable of producing hydrogen peroxide from oxygen, for example from atmospheric oxygen. Enzymes such as these are normally referred to as oxidases and are classified according to their substrate. Oxidases are redox enzymes with the classification EC 1 (under the Enzyme Commission Classification) which are generally flavine-dependent and of which the oxidized form is capable of oxidizing a substrate. The reduced form of the enzyme thus formed is re-oxidized by molecular oxygen in aqueous systems, hydrogen peroxide being formed as another product. Examples of such enzymes and their substrates which follow from the name of the enzyme are phenol oxidase, amino acid oxidase, xanthine oxidase, urate oxidase, alcohol oxidase, cholesterol oxidase and glucose oxidase. The use of oxidase in detergents has already been proposed on various occasions. Thus, DE-OS 19 18 729 describes detergents which, besides surfactants, contain 0.5% by weight to 10% by weight of glucose oxidase and 5% by weight to 30% by weight of glucose or starch. In the latter case, the detergent is said to additionally contain 0.5% by weight to 10% by weight of amyloglucosidase. DE-OS-20 64 146 discloses detergents containing 1% by weight to 50% by weight of water-soluble surfactant and 0.01% by weight to 2% by weight of lipoxidase. Polyunsaturated fatty acids are preferably additionally present as substrates for the lipoxidase. DE-OS-25 57 623 describes detergents which, in addition to surfactants and builders, contain 0.3% by weight to 10% by weight of urate oxidase, galactose oxidase or $C_{1-3}$ alcohol oxidase and 3% by weight to 30% by weight or uric acid, galactose or $C_{1-3}$ alcohols and/or corresponding keto alcohols. European patent EP 0 072 098 relates to liquid bleaching compositions containing a $C_{1-4}$ alcohol oxidase and a $C_{1-4}$ alcohol. According to European patent application EP 0 603 931, the glucose oxidase/glucose system is stabilized in liquid detergents by the addition of $Cu^{2+}$ and/or $Ag^{+}$ ions and the bleaching effect of the enzymatically produced hydrogen peroxide is enhanced by the presence of bleaching catalysts, more especially metal porphins, metal porphyrins, metal phthalocyanines and/or haemin. International patent application WO 95/07972 has the same objective and relates to bleaching compositions which contain an enzymatic system for producing hydrogen peroxide and a bleach-catalyzing co-ordination complex of Mn or Fe. International patent application WO 94/25574 discloses an L-amino acid oxidase of a certain strain of the microorganism *Trichoderma harzianum* and detergents containing this oxidase. The enzymatic systems mentioned may be used for producing hydrogen peroxide to be activated in accordance with the invention. However, a bleaching system of an amino alcohol or D-amino acid oxidase and a substrate for this oxidase known from German patent application DE 195 45 729 is preferably used, the expression "amino alcohol substrate" also encompassing compounds containing a quaternized amine function, more particularly a molecule formed from the compound of formula I after hydrolytic or perhydrolytic cleavage of at least one ester function, for example a molecule corresponding to formula II. It is particularly preferred to use choline oxidase which is produced, for example, by Alcaligenes species or by *Arthrobacter globiformis*. D-amino acid oxidase of standardized activity—obtained for example from pigs kidneys—is commercially available and, like choline oxidase, is marketed, for example, by Sigma. An oxidase is preferably used in compositions according to the invention is such quantities that the composition as a whole has an oxidase activity of 30 U/g to 20,000 U/g and, more particularly, from 60 U/g to 15,000 U/g. Compositions having oxidase activities in the ranges mentioned release hydrogen peroxide sufficiently quickly, more particularly for standard European machine washing processes.

Besides the activator containing an enzyme substrate leaving group to be used in accordance with the invention and the peroxygen-based bleaching agent, the laundry detergents, dishwashing detergents and disinfectants according to the invention, which may be present in particular as powder-form solids, in the form of post-compacted particles, a homogeneous solutions or suspensions, may in principle contain any known ingredients typically encountered in such products. More particularly, the laundry detergents and dishwashing detergents according to the invention may contain builders, surfactants, water-miscible organic solvents, enzymes, sequestering agents, electrolytes, pH regulators and other auxiliaries, such as optical brighteners, redeposition inhibitors, dye transfer inhibitors, foam regulators, additional peroxygen activators, dyes and fragrances. A disinfectant according to the invention may contain typical antimocrobial agents in addition to the ingredients mentioned thus far in order to enhance its effectiveness against special germs. The antimicrobial agents in question are present in the disinfectants according to the invention in quantities of preferably up to 10% by weight and, more preferably, from 0.1% by weight to 5% by weight.

The compositions according to the invention may contain one or more surfactants, more especially anionic surfactants, nonionic surfactants and mixtures thereof. Suitable nonionic surfactants are, in particular, alkyl glycosides and ethoxylation and/or propoxylation products of alkyl glycosides or linear or branched alcohols containing 12 to 18 carbon atoms in the alkyl moiety and 3 to 20 and preferably 4 to 10 alkyl ether groups. Corresponding ethoxylation and/or propoxylation products of N-alkyl amines, vicinal diols, fatty acid esters and fatty acid amides, which correspond to the long-chain alcohol derivatives mentioned in regard to the alkyl moiety, and of alkyl phenols containing 5 to 12 carbon atoms in the alkyl group may also be used.

Suitable anionic surfactants are, in particular, soaps and anionic surfactants which contain sulfate or sulfonate groups with preferably alkali metal ions as cations. Preferred soaps are the alkali metal salts of saturated or unsaturated fatty acids containing 12 to 18 carbon atoms. Fatty acids such as these may also be used in incompletely neutralized form. Suitable surfactants of the sulfate type are the salts of sulfuric acid semiesters of fatty alcohols containing 12 to 18 carbon atoms and sulfation products of the nonionic surfactants mentioned with a low degree of ethoxylation. Suitable surfactants of the sulfonate type include linear alkyl benzenesulfonates containing 9 to 14 carbon atoms in the alkyl moiety, alkane sulfonates containing 12 to 18 carbon atoms and olefin sulfonates containing 12 to 18 carbon atoms, which are formed in the reaction of corresponding monoolefins with sulfur trioxide, and α-sulfofatty acid esters which are formed in the sulfonation of fatty acid methyl or ethyl esters. It is extremely surprising in this connection that the bleach-boosting effect of esterquats corresponding to general formula (I) is developed even in the presence of such anionic surfactants.

Surfactants of the type in question are present in the laundry detergents according to the invention in quantities of preferably 5% by weight to 50% by weight and, more preferably, 8% by weight to 30% by weight whereas the disinfectants according to the invention and dishwashing detergents according to the invention preferably contain 0.1% by weight to 20% by weight and, more preferably, 0.2% by weight to 5% by weight of surfactants.

A composition according to the invention preferably contains at least one water-soluble and/or water-insoluble organic and/or inorganic builder. Suitable water-soluble organic builders include polycarboxylic acids, more particularly citric acid, and sugar acids, monomeric and polymeric aminopolycarboxylic acids, more particularly methyl glycine diacetic acid, nitrilotriacetic acid and ethylenediamine tetraacetic acid and polyaspartic acid, polyphosphonic acids, more especially aminotris(methylene phosphonic acid), ethylenediamine tetrakis(methylene phosphonic acid) and 1-hydroxyethane-1,1-diphosphonic acid, polymeric hydroxy compounds, such as dextrin, and polymeric (poly)carboxylic acids, more especially the polycarboxylates obtainable by oxidation of polysaccharides according to International patent application WO 93/16110, polymeric acrylic acids, methacrylic acids, maleic acids and copolymers thereof which may also contain small amounts of polymerizable substances with no carboxylic acid functionality in copolymerized form. The relative molecular weight of the homopolymers of unsaturated carboxylic acids is generally in the range from 5,000 to 200,000 while the relative molecular weight of the copolymers is between 2,000 and 200,000 and preferably in the range from 50,000 to 120,000, based on free acid. A particularly preferred acrylic acid/maleic acid copolymer has a relative molecular weight of 50,000 to 100,000. Suitable but less preferred compounds of this class are copolymers of acrylic acid or methacrylic acid with vinyl ethers, such as vinyl methyl ethers, vinyl ester, ethylene, propylene and styrene, in which the acid makes up at least 50% by weight. Other suitable water-soluble organic builders are terpolymers which contain two unsaturated acids and/or salts thereof as monomers and vinyl alcohol and/or an esterified vinyl alcohol or a carbohydrate as the third monomer. The first acidic monomer or its salt is derived from a monoethylenically unsaturated $C_{3-8}$ carboxylic acid and preferably from a $C_{3-4}$ monocarboxylic acid, more especially (meth)acrylic acid. The second acidic monomer or its salt may be a derivative of a $C_{4-8}$ dicarboxylic acid, maleic acid being particularly preferred, and/or a derivative of an allyl sulfonic acid substituted in the 2-position by an alkyl or aryl group. Polymers such as these can be produced in particular by the processes described in German patent DE 42 21 381 and in German patent application DE 43 00 772 and generally have a relative molecular weight of 1,000 to 200,000. Other preferred copolymers are those which are described in German patent applications DE 43 03 320 and DE 44 17 734 and which preferably contain acrolein and acrylic acid/acrylic acid salts or vinyl acetate as monomers. The inorganic builders may be used in the form of aqueous solutions, preferably 30 to 50% by weight aqueous solutions, especially for the production of liquid compositions. All the acids mentioned are generally used in the form of their water-soluble salts, more especially their alkali metal salts.

Organic builders of the type mentioned may optionally be present in quantities of up to 40% by weight, more particularly in quantities of up to 25% by weight and preferably in quantities of 1 to 8% by weight. Quantities near the upper limit mentioned are preferably used in paste-form or liquid, more especially water-containing, compositions according to the invention.

Suitable water-soluble inorganic builders are, in particular, polyphosphates, preferably sodium triphosphate. The water-insoluble, water-dispersible inorganic builders used are, in particular, crystalline or amorphous alkali metal alumosilicates which are present in quantities of up to 50% by weight and preferably in quantities of not more than 40% by weight and—in liquid compositions—particularly in quantities of 1% by weight to 5% by weight. Of these inorganic builders, crystalline sodium aluminosilicates in detergent quality, more especially zeolite A, P and optionally X, are preferred. Quantities near the upper limit mentioned are preferably used in solid particulate compositions. Suitable aluminosilicates do not contain any particles larger than 30 μm in size, at least 80% by weight preferably consisting of particles less than 10 μm in size. Their calcium binding capacity as determined in accordance with German patent DE 24 12 837 is generally in the range from 100 to 200 mg CaO per gram.

Suitable substitutes or partial substitutes for the aluminosilicate mentioned are crystalline alkali metal silicates which may be present either on their own or in the form of a mixture with amorphous silicates. The alkali metal silicates suitable for use as builders in the compositions according to the invention preferably have a molar ratio of alkali metal oxide to $SiO_2$ of less than 0.95:1 and, more particularly, from 1:1.1 to 1:12 and may be present in amorphous or crystalline form. Preferred alkali metal silicates are the sodium silicates, more particularly the amorphous sodium silicates, with a molar $Na_2O:SiO_2$ ratio of 1:2 to 1:2.8. Those with a molar $Na_2O:SiO_2$ ratio of 1:1.9 to 1:2.8 may be produced by the process according to European patent application EP 0 425 427. Preferred crystalline silicates, which may be present either on their own or in the form of a mixture with amorphous silicates, are crystalline layer silicates with the general formula $Na_2Si_xO_{2x+1}.yH_2O$, where x—the so-called modulus—is a number of 1.9 to 4 and y is a number of 0 to 20, preferred values for x being 2, 3 or 4. Crystalline layer silicates which correspond to this general formula are described, for example, in European patent application EP 0 164 514. Preferred crystalline layer silicates are those in which x in the general formula mentioned assumes a value of 2 or 3. Both β- and δ-sodium disilicates ($Na_2Si_2O_5.yH_2O$) are particularly preferred, β-sodium disilicate being obtainable, for example, by the process described in International patent application WO 91/08171. δ-Sodium silicates with a modulus of 1.9 to 3.2 may be produced in accordance with Japanese patent applications JP 04/238 809 or JP 04/260 610. Substantially water-free crystalline alkali metal silicates corresponding to the above general formula, in which x is a number of 1.9 to 2.1, obtainable from amorphous alkali metal silicates as described in European patent applications EP 0 548 599, EP 0 502 325 and EP 0 452 428, may also be used in the compositions according to the invention. Another preferred embodiment of compositions according to the invention uses a crystalline sodium layer silicate with a modulus of 2 to 3 obtainable from sand and soda by the process according to European patent application EP 0 436 835. Crystalline sodium silicates with a modulus of 1.9 to 3.5 obtainable by the processes according to European patents EP 0 164 552 and/or EP 0 293 753 are used in another preferred embodiment of the compositions according to the invention. If alkali metal alumosilicate, particularly zeolite, is present as an additional buffer builder, the ratio by weight of alumonosilicate to silicate, expressed as water-free active substances, is preferably from 1:10 to 10:1. In compositions containing both amorphous and crystalline alkali metal silicates, the ratio by weight of amorphous alkali metal silicate to crystalline alkali metal silicate is preferably 1:2 to 2:1 and, more preferably, 1:1 to 2:1.

Builders are present in the detergents or cleaners according to the invention in quantities of, preferably, up to 60% by weight and, more preferably, from 5% by weight to 40% by weight while the disinfectants according to the invention are preferably free from the builders which only complex the components of water hardness and contain preferably no more than 20% by weight and, more preferably, from 0.1% by weight to 5% by weight of heavy metal complexing agents, preferably from the group consisting of aminopolycarboxylic acids, aminopolyphosphonic acids and hydroxypolyphosphonic acids and water-soluble salts and mixtures thereof.

Besides typical bleach activators which do not release an enzyme substrate leaving group under perhydrolysis conditions, the additional bleach-boosting ingredients optionally present in compositions according to the invention include in particular bleach-catalyzing transition metal salts and/or complexes which are preferably selected from cobalt, iron, copper, titanium, vanadium, manganese and ruthenium complexes. Ligands which may be present in the transitional metal complexes usable in accordance with the invention are any of the typical, both inorganic and organic substances. Besides carboxylates, organic ligands in such complexes include in particular compounds containing primary, secondary and/or tertiary amine and/or alcohol functions, such as pyridine, pyridazine, pyrimidine, pyrazine, imidazole, pyrazole, triazole, 2,2'-bis-pyridyl amine, tris-(2-pyridylmethyl)-amine, 1,4,7-triazacyclononane, 1,4,7-trimethyl-1,4,7-triazacyclononane, 1,5,9-trimethyl-1,5,9-triazacyclododecane, (bis-((1-methylimidazol-2-yl)-methyl))-(2-pyridylmethyl)-amine, N,N'-(bis-(1-methylimidazol-2-yl)-methyl)-ethylenediamine, N-bis-(2-benzimidazolylmethyl)-aminoethanol, 2,6-bis-(bis-(benzimidazolylmethyl)-aminomethyl)-4-methyl phenol, N,N,N',N'-tetrakis-(2-benzimidazolylmethyl)-2-hydroxy-1,3-diaminopropane, 2,6-bis-(bis-(2-pyridylmethyl)-aminomethyl)-4-methyl phenol, 1,3-bis-(bis-(2-benzimidazolylmethyl)-aminomethyl)-benzene, sorbitol, mannitol, erythritol, adonitol, inositol, lactose and optionally substituted salens, porphins and porphyrins. The inorganic neutral ligands include in particular ammonia and water. The presence of at least one ammonia ligand is preferred, particularly in the Co(III) complexes where the central atom is normally present with a co-ordination number of 6. Unless all of the coordination sites of the transition metal central atom are occupied by neutral ligands, a complex to be used in compositions according to the invention contains other, preferably anionic ligands, more particularly monodentate or bidentate ligands. These include in particular the halides, such as fluoride, chloride, bromide and iodide, and the $(NO_2)^-$ group. In the present case, an $(NO_2)^-$ group is a nitroligand which is attached to the transition metal by the nitrogen atom or a nitroligand which is attached to the transition metal by an oxygen atom. The $(NO_2)^-$ group may also be attached to a transition metal to form a chelate or may form an asymmetrical or $\eta^1$-O— bridge between two transition metal atoms. Besides the ligands mentioned, the transition metal complexes optionally used may contain other ligands of generally more simple structure, more particularly mono- or polyvalent anionic ligands. Examples of such other ligands are nitrate, acetate, trifluoroacetate, formate, carbonate, citrate, perchlorate and complex anions, such as hexafluorophosphate. The anionic ligands are intended to provide for charge equalization between the transition metal central atom and the ligand system. Oxo ligands, peroxo ligands and imino ligands may also be present. These ligands may also have a bridging effect so that polynuclear complexes are formed. In the case of bridged binuclear complexes, the two metal atoms in the complex do not have to be the same. Binuclear complexes in which the two transition metal central atoms have different oxidation numbers may also be used. In the absence of anionic ligands or if the presence of anionic ligands does not lead to charge equalization in the complex, the transition metal complex compounds contain anionic counterions which neutralize the cationic transition metal complex. These anionic counterions include in particular nitrate, hydroxide, hexafluorophosphate, sulfate, chlorate, perchlorate, the halides, such as chloride, or the anions of carboxylic acids, such as formate, acetate, benzoate or citrate. Examples of transition metal complex compounds suitable for use in accordance with the invention are $Mn(IV)_2(\mu—O)_3(1,4,7\text{-triazacyclononane})_2$-dihexafluorophosphate, $Mn(IV)_2(\mu—O)_3$(1,4,7-trimethyl-1,4,7-triazacyclononane)$_2$-dihexafluorophosphate, $Mn(IV)_4(\mu—O)_6(1,4,7\text{-triazacyclononane})_4$-tetraperchlorate, $Mn(IV)_4(\mu—O)_6$(1,4,7-trimethyl-1,4,7-triazacyclononane)$_4$-tetraperchlorate, [N,N'-bis-[(2-hydroxy-5-vinylphenyl)-methylene]-1,2-diaminocyclohexane]-manganese(III) chloride, [N,N'-bis-[(2-hydroxy-5-nitrophenyl)-methylene]-1,2-diaminocyclohexane]-manganese(III) acetate, [N,N'-bis-[(2-hydroxyphenyl)-methylene]-1,2-phenylenediamine]-manganese(III) acetate, [N,N'-bis-[(-2-hydroxyphenyl)-methylene]-1,2-diaminocyclohexane]-manganese(III) chloride, [N,N'-bis-[(2-hydroxyphenyl)-methylene]-1,2-diaminoethane]-manganese (III) chloride, [N,N'-bis-[(-2-hydroxy-5-sulfonatophenyl)-methylene]-1,2-diaminoethane]-manganese(III) chloride, nitropentammine cobalt(III) chloride, nitropentammine cobalt(III), hexammine cobalt(III) chloride, chloropentammine cobalt(III) chloride and the peroxo complex $[(NH_3)_5Co—O—O—Co(NH_3)_5]Cl_4$. Other examples of bleaching catalysts suitable for use in accordance with the invention are ammonium and alkali metal molybdates and tungstates which may also be used in the form of polymolybdates and polytungstates.

Enzymes suitable for use in the detergent/disinfectants are enzymes from the class of proteases, lipases, cutinases, amylases, pullulanases, hemicellulases, cellulases, oxidases and peroxidases and mixtures thereof, i.e. enzymes which have no perhydrolysis activity in the sense according to the invention. Particularly suitable enzymes are those obtained from fungi or bacteria, such as *Bacillus subtilis, Bacillus licheniformis, Streptomycs griseus, Humicola lanuginosa, Humicola insolens, Pseudomonas pseudoalcaligenes* or *Pseudomonas cepacia.* As described for example in International patent applications WO 92/11347 or WO 94/23005, the enzymes optionally used may be adsorbed onto supports and/or encapsulated in shell-forming substances to protect them against premature inactivation. They are added to the detergents/disinfectants according to the invention in quantities of preferably up to 5% by weight and, more preferably, between 0.2% by weight and 2% by weight. By virtue of their additional bleaching effect or effectiveness in inhibiting dye transfer, particular preference is attributed to the use of peroxidases which may optionally be used in combination with so-called mediators which are known, for example from International patent applications WO 94/12619, WO 94/12620 and WO 94/12621.

Organic solvents suitable for use in the formulations according to the invention, particularly where they are present in liquid or paste-like form, include alcohols containing 1 to 4 carbon atoms, more particularly methanol, ethanol, isopropanol and tert.butanol, diols containing 2 to 4 carbon atoms, more particularly ethylene glycol and propylene glycol, and mixtures thereof and the ethers derived from compounds belonging to the classes mentioned above. Water-miscible solvents such as these are present in the detergents/disinfectants according to the invention in quantities of preferably not more than 30% by weight and, more preferably, in quantities of 6% by weight to 20% by weight.

To establish a desired pH value which is not automatically adjusted by the mixture of the other components, the compositions according to the invention may contain system-compatible and ecologically compatible acids, more particularly citric acid, acetic acid, tartaric acid, malic acid, lactic acid, glycolic acid, succinic acid, glutaric acid and/or adipic acid, and mineral acids, more particularly sulfuric acid, or bases, more particularly ammonium or alkali metal hydroxides. pH regulators such as these are present in the compositions according to the invention in quantities of preferably not more than 20% by weight and, more preferably, between 1.2% by weight and 17% by weight.

The compositions according to the invention may additionally contain other typical detergent ingredients. These optional ingredients include in particular enzyme stabilizers, soil-release agents, such as copolymers of dicarboxylic acids and diols and/or polyether diols, redeposition inhibitors, such as carboxymethyl cellulose, dye transfer inhibitors, for example polyvinyl pyrrolidone or polyvinyl pyridine-N-oxide, foam inhibitors, for example organopolysiloxanes or paraffins, and optical brighteners, for example stilbenedisulfonic acid derivatives.

The production of the solid compositions according to the invention does not involve any difficulties and may be carried out by methods known in principle, for example by spray drying or granulation, the peroxygen compound, bleach-activating system and any enzymes present optionally being added later. To produce compositions according to the invention with a high bulk density, more particularly in the range from 650 g/l to 950 g/l, a process comprising an extrusion step known from European patent EP 486 592 is preferably applied. Detergents, cleaners or disinfectants according to the invention in the form of aqueous solutions or solutions containing other typical solvents are produced with particular advantage simply by mixing the ingredients which may be introduced into an automatic mixer either as such or in the form of a solution. In one preferred embodiment of machine dishwashing detergents, the detergents are in tablet form and may be produced by the processes disclosed in European patents EP 0 579 659 and EP 0 591 282.

EXAMPLES

Example 1

Aqueous hydrogen peroxide was added to aqueous solutions containing a bleach activator to be used in accordance with the invention (counterion methosulfate) corresponding to the formula R—CO—$OCH_2CH_2$—$N^+(CH_3)_3$ (R as defined in Table 1) in the concentration shown in Table 1 and a pH buffer system in such a quantity that the solutions had the available oxygen concentration of $H_2O_2$ (ppm AO) shown in Table 1. After contact times (t) of 20 minutes to 60 minutes, the quantity of percarboxylic acid formed (again expressed in ppm active oxygen) was iodometrically determined.

TABLE 1

| R | Concentration [%] | $H_2O_2$ [ppm AO] | t [minutes] | pH | Peracid [ppm AO] |
|---|---|---|---|---|---|
| $C_3H_7$ | 1 | 94 | 30 | 9 | 8 |
| $C_7H_{15}$ | 1 | 1000 | 30 | 9 | 24.7 |
| $C_{15}H_{31}$ | 0.5 | 200 | 20 | 10 | 2 |
| $C_{15}H_{31}$ | 1 | 200 | 30 | 10 | 2.5 |

Example 2

The procedure was as in Example 1 except that a detergent containing an anionic surfactant but no bleach or bleach activator was used in concentrations of practical relevance instead of the pH buffer system. The peracid concentrations shown in Table 2 were obtained.

TABLE 2

| R | Concentration [%] | $H_2O_2$ [ppm AO] | t [minutes] | Peracid [ppm AO] |
|---|---|---|---|---|
| $C_7H_{15}$ | 1 | 1000 | 30 | 34.3 |
| $C_7H_{15}$ | 0.5 | 1000 | 30 | 29.3 |

Example 3

The procedure was as in Example 1 except that bleach activators (conterion methosulfate) with the formula $(R—CO—OCH_2CH_2)_2N^+(CH_3)_2$ were used. The quantities of peracid formed are shown in Table 3.

TABLE 3

| R | Concentration [%] | $H_2O_2$ [ppm AO] | t [minutes] | pH | Peracid [ppm AO] |
|---|---|---|---|---|---|
| $C_7H_{15}$ | 1 | 1000 | 30 | 9 | 26.8 |
| $C_8H_{17}$ | 1 | 1000 | 30 | 9 | 29 |

Example 4

The procedure was as in Example 3 except that a detergent containing an anionic surfactant but no bleach or bleach activator was used in concentrations of practical relevance instead of the pH buffer system. The peracid concentrations shown in Table 4 were obtained.

TABLE 4

| R | Concentration [%] | $H_2O_2$ [ppm AO] | t [minutes] | Peracid [ppm AO] |
|---|---|---|---|---|
| $C_7H_{15}$ | 1 | 1000 | 30 | 12.3 |
| $C_7H_{15}$ | 0.5 | 1000 | 30 | 7.3 |
| $C_8H_{17}$ | 1 | 1000 | 30 | 14.5 |
| $C_8H_{17}$ | 0.5 | 1000 | 30 | 9.5 |

Example 5

The procedure was as in Example 1 except that bleach activators (counterion methosulfate) with the formula $(R—CO—OCH_2CH_2)_3N^+CH_3$ were used. The quantities of peracid formed are shown in Table 5.

TABLE 5

| R | Concentration [%] | $H_2O_2$ [ppm AO] | t [minutes] | pH | Peracid [ppm AO] |
|---|---|---|---|---|---|
| $C_7H_{15}$ | 1 | 1000 | 30 | 9 | 11.5 |

Example 6

The procedure was as in Example 5 except that a detergent containing an anionic surfactant but no bleach or bleach activator was used in concentrations of practical relevance instead of the pH buffer system. The peracid concentration shown in Table 6 was obtained.

TABLE 6

| R | Concentration [%] | $H_2O_2$ [ppm AO] | t [minutes] | Peracid [ppm AO] |
|---|---|---|---|---|
| $C_7H_{15}$ | 0.5 | 1000 | 30 | 12.6 |

What is claimed is:

1. A detergent or disinfectant composition comprising one or more ingredients selected from the group consisting of surfactants, builders, solvents, enzymes, sequestering agents, electrolytes, pH regulators, optical brighteners, redeposition inhibitors, dye transfer inhibitors, foam regulators, dyes, fragrances, antimicrobial agents, and peroxygen activators, said composition further comprising:

(a) 0.5 to 10 percent by weight of an activator compound which under perhydrolysis conditions forms a percarboxylic acid, and releases a leaving group capable of being used as a substrate for enzymes, said activator compound comprising a quarternized carboxylic acid alkanolamine of formula (I):

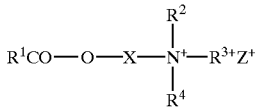

(I)

wherein $R^1CO—$ is a saturated or unsaturated acyl group containing 2 to 22 carbon atoms, $R^2$ is an optionally substituted, linear or branched alkyl, alkenyl or acyl group containing 1 to 22 carbon atoms or the group —X—OH, $R^3$ and $R^4$ independently of one another have the same meaning as $R^2$ or stand for $R^1CO—O—X—$, X is a linear or branched alkylene group containing 2 to 22 carbon atoms optionally interrupted by 1 to 10 oxygen atoms, and $Z^-$ is a charge-equalizing anion; and (b) up to 50 percent by weight of a peroxygen compound.

2. The composition of claim 1 comprising from 1 to 8 percent by weight of said compound (a) which forms a percarboxylic acid under perhydrolysis conditions.

3. The composition of claim 1 comprising from 0.5 to 40 percent by weight of said peroxygen compound.

4. The composition of claim 3 comprising from 5 to 30 percent by weight of said peroxygen compound.

5. The composition of claim 4 comprising from 5 to 20 percent by weight of said peroxygen compound.

6. The composition of claim 1 wherein in the compound of formula (I), $R^1CO—$ is a saturated or unsaturated acyl group containing 2 to 12 carbon atoms, $R^2$ is an optionally substituted alkyl or alkenyl group containing 1 to 3 carbon atoms, and Z— stands for a halide, methosulfate or ethosulfate.

7. The composition of claim 6 wherein in the compound of formula (I), $R^1CO—$ is a saturated or unsaturated acyl group containing 8 to 10 carbon atoms.

8. The composition of claim 1 wherein in the compound of formula (I), at least one of the substituents of the quaternary nitrogen atom contains an alkylene group interrupted by oxygen atoms.

9. The composition of claim 1, wherein in the compound of formula (I), the group O—X is an oligomeric ethyleneoxy or propyleneoxy group wherein the degree of oligomerization is 2 to 5.

10. The composition of claim 1 wherein the compound of formula (I) comprises quaternization products of technical mon-/di-/triester mixtures wherein the degree of esterification is from 1.2 to 2.2.

11. The composition of claim 10 wherein said degree of esterification is from 1.5 to 1.9.

12. The composition of claim 1 wherein the peroxygen compound comprises an organic peracid or a peracidic salt of an organic acid, hydrogen peroxide or an inorganic salt that releases hydrogen peroxide under use conditions.

13. The composition of claim 12 wherein the peroxygen compound is hydrogen peroxide supplied by an enzymatic system.

14. The composition of claim 13 wherein the enzymatic system comprises an amino alcohol or D-amino acid oxidase, and a substrate for said oxidase.

15. The composition of claim 14 wherein said amino alcohol substrate comprises a molecule formed from the compound of formula (I) after cleavage of at least one ester function.

16. The composition of claim 1 wherein the released substrate is used by a redox-active enzyme.

17. The composition of claim 1 further comprising a bleach-catalyzing transition metal salt or complex.

18. The composition of claim 1 further comprising a peroxidase.

19. The composition of claim 18 further comprising a mediator.

20. A process for oxidizing, bleaching, dishwashing or disinfecting comprising:

(a) forming a composition comprising an activator compound which under perhydrolysis conditions forms percarboxylic acid and a leaving group which may be used as a substrate for enzymes, and a peroxygen compound, said activator compound comprising a quaternized carboxylic acid alkanolamine of formula (I):

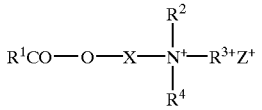

(I)

wherein $R^1CO$— is a saturated or unsaturated acyl group containing 2 to 22 carbon atoms, $R^2$ is an optionally substituted, linear or branched alkyl, alkenyl or acyl group containing 1 to 22 carbon atoms or the group —X—OH, $R^3$ and $R^4$ independently of one another have the same meaning as $R^2$ or stand for $R^1CO$—O—X—, X is a linear or branched alkylene group containing 2 to 22 carbon atoms optionally interrupted by 1 to 10 oxygen atoms, and $Z^-$ is a charge-equalizing anion; and (b) using said composition under perhydrolysis conditions.

21. The process of claim 20 wherein the perhydrolytic release of the percarboxylic acid is promoted by the catalysis of a hydrolase enzyme.

22. The process of claim 20 wherein the temperature during the process is below 80° C.

23. The process of claim 22 wherein the temperature during the process is from 15 to 40° C.

24. The process of claim 20 wherein perhydrolysis occurs in an aqueous solution.

25. The process of claim 20 wherein said composition comprises 10 ppm to 10 percent by weight of said peroxygen compound and 25 ppm to 1 percent by weight of an esterquat.

* * * * *

UNITED STATES PATENT AND TRADEMARK OFFICE

CERTIFICATE OF CORRECTION

PATENT NO. : 6,417,151 B1
DATED : July 9, 2002
INVENTOR(S) : Grothus et al.

It is certified that error appears in the above-identified patent and that said Letters Patent is hereby corrected as shown below:

Column 13,
Replace formula (I) as follows:

--

$$R^1CO\text{-}O\text{-}X\text{-}\overset{\overset{\displaystyle R^2}{|}}{\underset{\underset{\displaystyle R^4}{|}}{N^+}}\text{-}R^{3+}\,Z^- \qquad (I)$$

--

Column 15,
Replace formula (I) as follows:

--

$$R^1CO\text{-}O\text{-}X\text{-}\overset{\overset{\displaystyle R^2}{|}}{\underset{\underset{\displaystyle R^4}{|}}{N^+}}\text{-}R^{3+}\,Z^- \qquad (I)$$

--

Signed and Sealed this

Ninth Day of September, 2003

JAMES E. ROGAN
*Director of the United States Patent and Trademark Office*